US010588382B2

(12) United States Patent
Rushbrook

(10) Patent No.: US 10,588,382 B2
(45) Date of Patent: Mar. 17, 2020

(54) ARTICLE OF FOOTWEAR WITH CHANNELS IN SOLE STRUCTURE

(71) Applicant: NIKE, Inc., Beaverton, OR (US)

(72) Inventor: Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/904,898

(22) Filed: Feb. 26, 2018

(65) Prior Publication Data

US 2018/0184762 A1 Jul. 5, 2018

Related U.S. Application Data

(63) Continuation of application No. 14/445,621, filed on Jul. 29, 2014, now Pat. No. 9,907,361.

(51) Int. Cl.

| | |
|---|---|
| ***A43C 11/00*** | (2006.01) |
| ***A43B 13/14*** | (2006.01) |
| ***A43B 11/00*** | (2006.01) |
| ***A43C 1/06*** | (2006.01) |
| ***A43C 11/16*** | (2006.01) |

(52) U.S. Cl.

CPC ..... *A43C 11/002* (2013.01); *A43B 11/00* (2013.01); *A43B 13/14* (2013.01); *A43C 1/06* (2013.01); *A43C 11/00* (2013.01); *A43C 11/165* (2013.01)

(58) Field of Classification Search

CPC ..... A43B 11/00; A43B 13/14; A43B 13/00; A43B 5/0447; A43B 5/0449; A43B 13/16; A43C 11/002; A43C 1/06; A43C 11/00; A43C 11/165; A43C 11/16; A43C 1/00; A43C 1/003; A43C 1/006; A43C 1/04

USPC ..... 36/97, 50.1, 50.5, 51, 118.1, 102

See application file for complete search history.

(56) References Cited

U.S. PATENT DOCUMENTS

| | | | | |
|---|---|---|---|---|
| 4,000,566 A | | 1/1977 | Famolare, Jr. | |
| 4,270,285 A | | 6/1981 | Antonious | |
| 4,654,985 A | * | 4/1987 | Chalmers | A43B 3/0084 24/68 SK |
| 4,922,634 A | * | 5/1990 | Seidel | A43B 5/0449 36/117.8 |
| 4,969,278 A | | 11/1990 | Ottieri | |
| 4,972,610 A | | 11/1990 | Tong | |
| 5,205,055 A | | 4/1993 | Harrell | |

(Continued)

FOREIGN PATENT DOCUMENTS

| | | |
|---|---|---|
| GB | 2256574 A | 12/1992 |
| WO | 93/25107 A1 | 12/1993 |

(Continued)

OTHER PUBLICATIONS

International Search Report and Written Opinion dated Nov. 7, 2014 in PCT/US2014/044480.

(Continued)

*Primary Examiner* — Anna K Kinsaul
*Assistant Examiner* — F Griffin Hall
(74) *Attorney, Agent, or Firm* — Banner & Witcoff, Ltd.

(57) ABSTRACT

An article of footwear includes an upper and a sole structure. A set of tensioning members extend over the upper and into channels formed in the sole structure. The tensioning members travel through the channels and exit a rear opening of the sole structure where they may be tensioned using a manual or automatic tensioning device.

16 Claims, 14 Drawing Sheets

(56) References Cited

U.S. PATENT DOCUMENTS

| | | | |
|---|---|---|---|
| 5,791,068 | A | 8/1998 | Bernier et al. |
| 5,839,210 | A | 11/1998 | Bemier et al. |
| 5,934,599 | A | 8/1999 | Hammerslag |
| 6,032,387 | A | 3/2000 | Johnson |
| 6,378,230 | B1 | 4/2002 | Rotem et al. |
| 6,427,361 | B1 | 8/2002 | Chou |
| 6,467,194 | B1 | 10/2002 | Johnson |
| 6,691,433 | B2 | 2/2004 | Liu |
| 7,065,906 | B2 | 6/2006 | Jones et al. |
| 7,096,559 | B2 | 8/2006 | Johnson |
| 7,134,224 | B2 | 11/2006 | Elkington et al. |
| 7,392,990 | B2 | 7/2008 | Bussiere |
| 7,752,774 | B2 | 7/2010 | Ussher |
| 8,146,273 | B2 | 4/2012 | Sokolowski |
| 8,387,282 | B2 | 3/2013 | Baker et al. |
| 8,468,657 | B2 | 6/2013 | Soderberg et al. |
| 2004/0181972 | A1 | 9/2004 | Csorba |
| 2005/0076536 | A1 | 4/2005 | Hatfield et al. |
| 2007/0033836 | A1 | 2/2007 | Rasmussen |
| 2007/0039209 | A1 | 2/2007 | White et al. |
| 2007/0186447 | A1 | 8/2007 | Ramos |
| 2007/0209234 | A1 | 9/2007 | Chou |
| 2007/0240334 | A1 | 10/2007 | Johnson |
| 2008/0216351 | A1 | 9/2008 | Carroll et al. |
| 2009/0000153 | A1 | 1/2009 | Grimmeisen |
| 2010/0139057 | A1 | 6/2010 | Soderberg et al. |
| 2011/0258876 | A1 | 10/2011 | Baker et al. |
| 2012/0005923 | A1 | 1/2012 | Beers et al. |
| 2012/0117821 | A1 | 5/2012 | Adams et al. |
| 2014/0070042 | A1 | 3/2014 | Beers et al. |

FOREIGN PATENT DOCUMENTS

| | | | |
|---|---|---|---|
| WO | 2006/074067 | A1 | 7/2006 |
| WO | 2009/071652 | A1 | 6/2009 |

OTHER PUBLICATIONS

International Search Report and Written Opinion dated Jul. 31, 2015 in PCT/US2015/029401.

International Preliminary Report on Patentability and Written Opinion of the International Searching Authority dated Jan. 21, 2016 in International Patent Application No. PCT/US2014/044480.

* cited by examiner

ARTICLE OF FOOTWEAR WITH CHANNELS IN SOLE STRUCTURE

CROSS-REFERENCE TO RELATED APPLICATIONS

This application is a continuation of U.S. application Ser. No. 14/445,621, filed Jul. 29, 2014, entitled "Article Of Footwear With Channels in Sole Structure", the entirety of which is herein incorporated by reference.

BACKGROUND

The present embodiments relate generally to articles of footwear, and in particular to articles of footwear with tensioning systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

SUMMARY

In one aspect, an article of footwear includes an upper and a sole structure. The sole structure includes a distal surface and a proximal surface, where the proximal surface is disposed closer to the upper than the distal surface. The sole structure also includes a central longitudinal channel and at least one branching side channel that extends from the central longitudinal channel to a side edge of the sole structure. The article of footwear includes at least one tensioning member with a first portion, a second portion and a third portion. The first portion of the at least one tensioning member is disposed within the central longitudinal channel. The second portion of the at least one tensioning member is disposed within the at least one branching side channel. The third portion of the at least one tensioning member extends along a portion of the upper. The at least one tensioning member can be pulled through the central longitudinal channel and the at least one branching side channel to apply tension to the upper. The central longitudinal channel and the at least one branching side channel are open on the proximal surface of the sole structure.

In another aspect, an article of footwear includes an upper and a sole structure. The sole structure includes a distal surface and a proximal surface, where the proximal surface is disposed closer to the upper than the distal surface. The sole structure further includes a central longitudinal channel and at least one branching side channel that extends from the central longitudinal channel to a side edge of the sole structure. The article of footwear includes at least one tensioning member with a first portion, a second portion and a third portion. The first portion is disposed within the central longitudinal channel. The second portion is disposed within the at least one branching side channel. The third portion extends along a portion of the upper. At least one tensioning member can be pulled through the central longitudinal channel and the at least one branching side channel to apply tension to the upper. The central longitudinal channel has a first width and the at least one branching side channel having a second width. The first width is approximately equal to the second width.

In another aspect, an article of footwear includes an upper and a sole structure. The sole structure has a central longitudinal channel and at least one branching side channel that extends from the central longitudinal channel to a side edge of the sole structure. At least one tensioning member extends through the central longitudinal channel and at least one branching side channel, where a portion of the at least one tensioning member is disposed on the upper. At least one tensioning member can be pulled through the central longitudinal channel and at least one branching side channel to apply tension to the upper. The central longitudinal channel has a first width, at least one tensioning member has a second width and the article of footwear has a third width associated with the minimum width of the article of footwear. A first ratio of the third width to the first width is greater than a second ratio of the third width to the second width.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
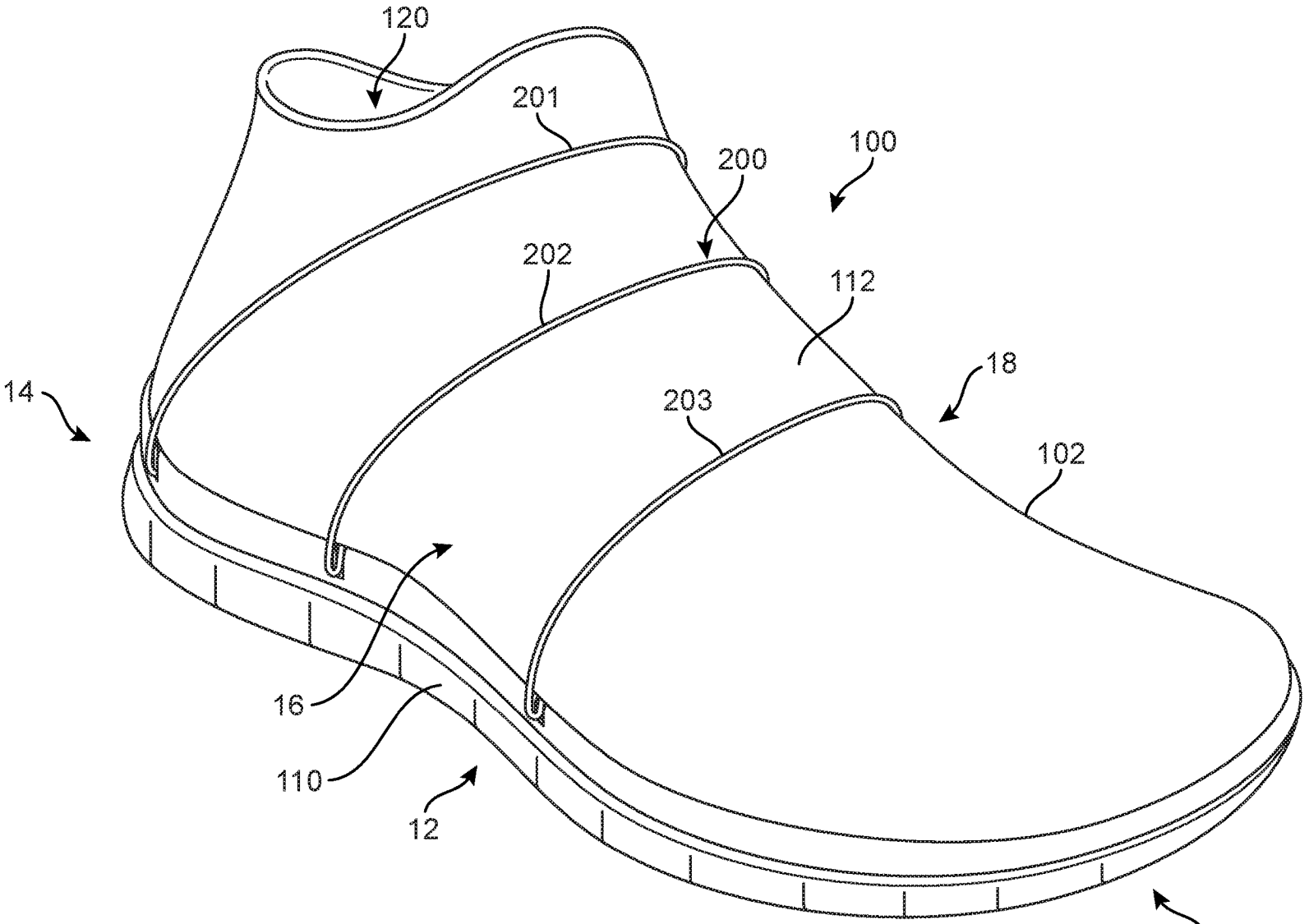
FIG. 1 is a schematic isometric view of an embodiment of an article of footwear including a tensioning system.

FIG. 1 is a schematic isometric view of an embodiment of an article of footwear 100, also referred to hereafter as simply article 100. Article 100 may be configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending along a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be used in describing individual components of an article, such as an upper and/or a sole structure.

Article 100 may include an upper 102 as well as a sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, upper 102 includes opening 120 that provides entry for the foot into an interior cavity of upper 102. In contrast to some other upper configurations, article 100 may generally be closed along the top of upper 102, including along instep portion 112. In other words, instep portion 112 may be configured as a closed portion. In particular, instep portion 112 may be closed around the instep of a foot, when a foot has been inserted into article 100.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

In order to facilitate entry of a foot into upper 102, instep portion 112 may include provisions for expanding and contracting. In some embodiments, article 100 may be configured with a tensioning system that may include a set of tensioning members 200. As seen in FIG. 1, set of tensioning members 200 may include a first tensioning member 201, a second tensioning member 202 and a third tensioning member 203, which are discussed in further detail below. In the exemplary configuration, each tensioning member is tensioned across the top and sides of upper 102, including over instep portion 112, thereby providing tension for tightening upper 102 around a foot.

Figure 2:
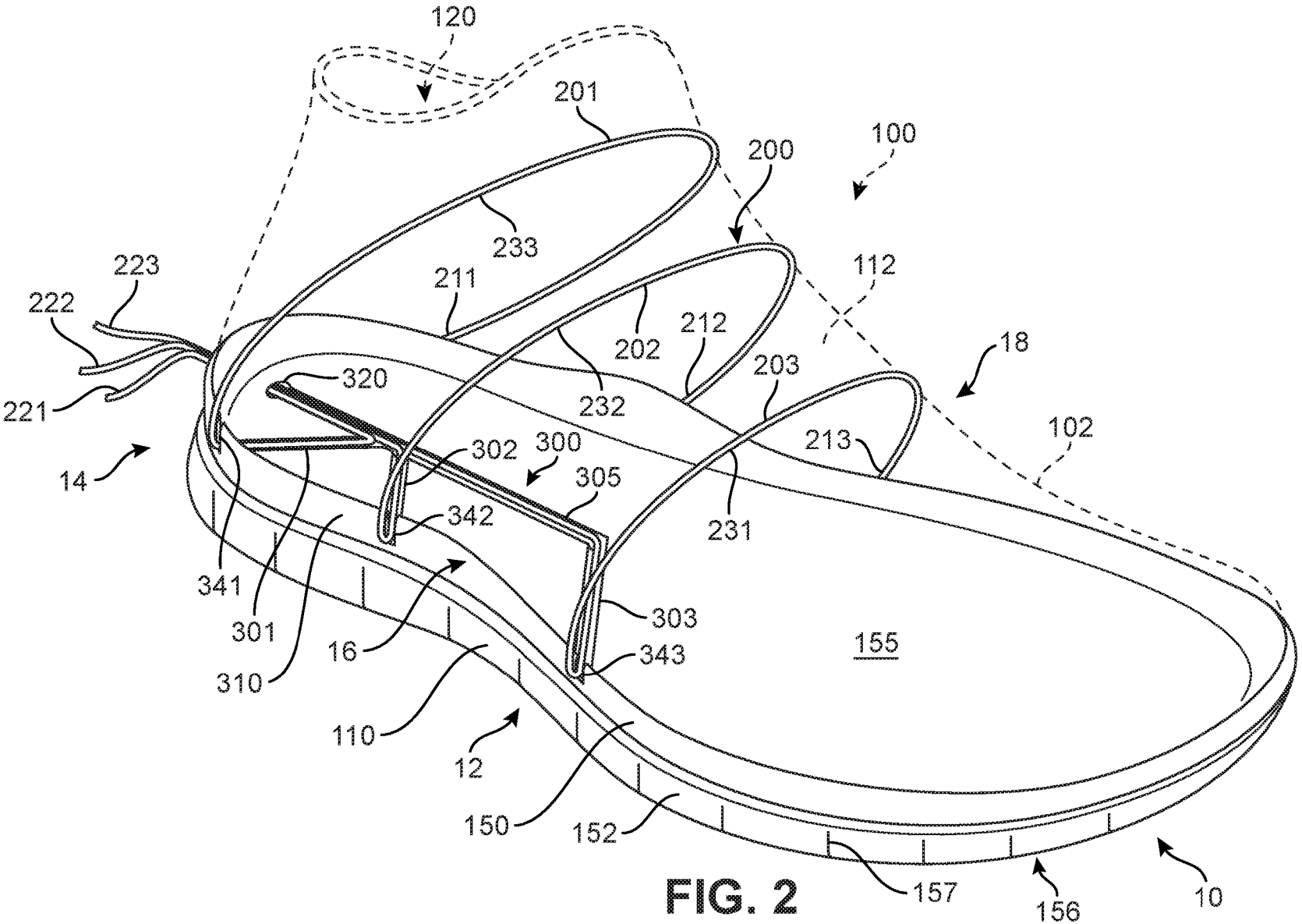
FIG. 2 is a schematic isometric view of the article of footwear of FIG. 1, in which the upper is shown in phantom.
Figure 3:
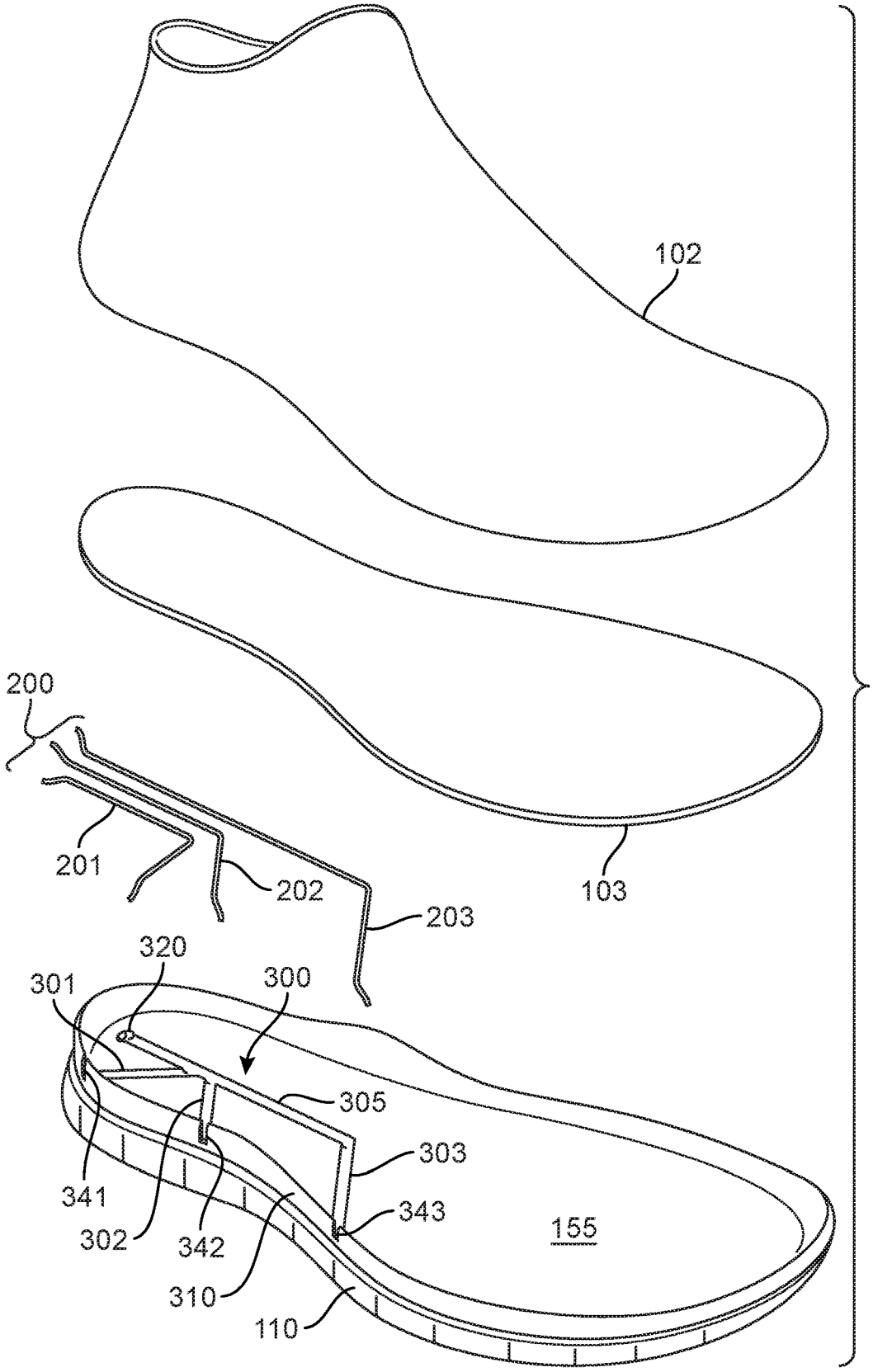
FIG. 3 is a schematic isometric exploded view of the article of footwear of FIG. 1.

FIGS. 2 and 3 illustrate a schematic isometric view and an exploded schematic isometric view, respectively, of article 100. Various structural features of sole structure 110 may be best understood by reference to FIGS. 2 and 3. In some embodiments, sole structure 110 may comprise an integral sole structure, including an outersole portion 152 and a midsole portion 150 that are integrally formed. In one exemplary embodiment, outersole portion 152 may include one or more sipes or grooves 157 that facilitate increased flexibility for outersole portion 152. In contrast, in some embodiments, midsole portion 150 may not include any sipes. However, in other embodiments, midsole portion 150 could also include sipes.

In still other embodiments, however, sole structure 110 may comprise a distinct midsole and a distinct outsole that are joined together using methods known in the art for bonding outsoles to midsoles.

Sole structure 110 may include a proximal surface 155 and a distal surface 156 that is opposite of proximal surface 155. Proximal surface 155 may be disposed closer to upper 102, as well as an interior cavity of upper 102, than distal surface 156. In other words, proximal surface 155 may be an interior or inwardly facing surface of sole structure 110. In some embodiments, proximal surface 155 could be configured to receive and contact a foot directly, while in other embodiments an insole, strobel liner or other layer of material may be disposed between a foot and proximal surface 155 when article 100 is worn. In contrast, distal surface 156 may be a ground facing or ground contacting surface.

As previously discussed, article 100 is configured with a plurality of tensioning members. These tensioning members may be used to apply tension at or across different portions of upper 102. In an exemplary embodiment, tensioning members may function as fasteners to secure a foot within upper 102. Examples of possible tensioning members that could be used include, but are not limited to: cables, wires, strings, laces, straps as well as any other kinds of tensioning members.

In an exemplary embodiment, set of tensioning members 200 may comprise cable-like or wire-like members. In particular, the tensioning members of the current embodiment may be characterized as being approximately one-dimensional. In other words, each tensioning member may generally have a length that is substantially greater than the width, thickness and/or diameter of the tensioning member. In other embodiments, however, one or more tensioning members could be approximately two-dimensional members (e.g., ribbons or straps).

Although the exemplary embodiment includes three different tensioning members, other embodiments could incorporate any other number of tensioning members. In some embodiments, for example, an article may include a single tensioning member. In still other embodiments, an article could include two tensioning members. In still other embodiments, an article could include four or more tensioning members.

Although the exemplary embodiment depicts three distinct tensioning members, other embodiments could incorporate tensioning members that are joined or otherwise integrated. For example, in another embodiment a single central element (such as a wire or cable) may extend through the middle of a sole structure and may be joined to three distinct elements that extend from the central element and across the upper. Such joining could be accomplished by knots, soldering (e.g., in the case of metal cables), melting (e.g., in the case of polymer cables), intermediate fasteners or any other means known for joining two or more cables, wires, strings, laces or other tensioning elements.

As most clearly seen in FIG. 2, each tensioning member can extend through portions of article 100. For example, first tensioning member 201 may include a first end portion 211 that is anchored to upper 102 (or, alternatively to sole structure 110) on medial side 18. From medial side 18, first tensioning member 201 extends over instep portion 112 of upper 102, down lateral side 16 of upper 102 and into sole structure 110. As discussed in further detail below, a portion of first tensioning member 201 extends within sole structure 110 and exits sole structure 110 at heel portion 14. A second end portion 221 of first tensioning member 201 may extend outwardly from article 100 and can be manually pulled or may be attached to a tensioning device of some kind. In a similar manner, second tensioning member 202 and third tensioning member 203 extend over instep portion 112 and through sole structure 110. Specifically, second tensioning member 202 and third tensioning member 203 are anchored to medial side 18 of article 100 at a first end portion 212 and a first end portion 213, respectively. Likewise, a second end portion 222 and a second end portion 223 of second tensioning member 202 and third tensioning member 203, respectively, extend outwardly from sole structure 110 to be manually actuated or attached to a tensioning device.

Embodiments may utilize a tensioning device to apply tension to one or more tensioning members. For purposes of illustration, the embodiments do not depict a tensioning device. Instead, it is to be understood that the ends of one or more tensioning members could be attached to a tensioning device of some kind. Exemplary tensioning devices include, but are not limited to: winding devices (e.g., reels and spools), springs, as well as any other devices, systems or components that can be used to apply tension to any portion of a tensioning member. Further exemplary tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Pat. No. 8,468,657, issued Jun. 25, 2013, also published as U.S. Patent Publication Number 2010/0139057 on Jun. 10, 2010 and titled "Reel Based Lacing System", the entirety of which is hereby incorporated by reference. Examples of a motorized tensioning device that could be used with the current embodiments are disclosed in Beers et al., U.S. Patent Application Publication Number 2014/0070042, published on Mar. 13, 2014, which was filed as U.S. patent application Ser. No. 14/014,555 on Aug. 30, 2013, and titled "Motorized Tensioning System with Sensors", the entirety being incorporated by reference herein.

An exemplary configuration for an article with a closed instep portion that further utilizes tensioning members and a tensioning device to tighten the upper is disclosed in Beers, U.S. Patent Application Publication Number 20150013184, now U.S. patent application Ser. No. 13/939,208, filed Jul. 11, 2013, and titled "Article with Closed Instep Portion Having Variable Volume", the entirety of which is hereby incorporated by reference. In particular, in an exemplary embodiment, second end portion 221 of first tensioning member 201, second end portion 222 of second tensioning member 202 and second end portion 223 of third tensioning member 203 may be attached to an automated reel-based tensioning device. This tensioning device may automatically apply tension to the tensioning members (e.g., by winding a spool to which the tensioning members are attached) in response to information obtained by sensors and/or in response to user commands (e.g., a user pressing a wind/unwind button on a control device).

Embodiments may include provisions to facilitate the travel of one or more tensioning members through sole structure 110. In some embodiments, sole structure 110 can include features to retain portions of one or more tensioning members. Exemplary features may include, but are not limited to: grooves, channels, passages, cavities as well as any other features. In an exemplary embodiment, sole structure 110 may be provided with one or more channels that are configured to receive portions of each tensioning member.

As seen in FIGS. 2 and 3, sole structure 110 may be provided with a set of channels 300. In some embodiments, set of channels 300 may comprise a central longitudinal channel 305, which may extend along an anterior-posterior axis (not shown) of sole structure 110. In addition, in some embodiments, set of channels 300 may include one or more branching side channels, which extend from central longitudinal channel 305 towards a side edge of sole structure 110. In particular, in an exemplary embodiment, set of channels 300 includes first branching side channel 301, second branching side channel 302 (also referred to as a first additional channel) and third branching side channel 303 (also referred to as a second additional channel). Each branching side channel may extend from central longitudinal channel 305 to lateral side edge 310 of sole structure 110.

Figure 4:
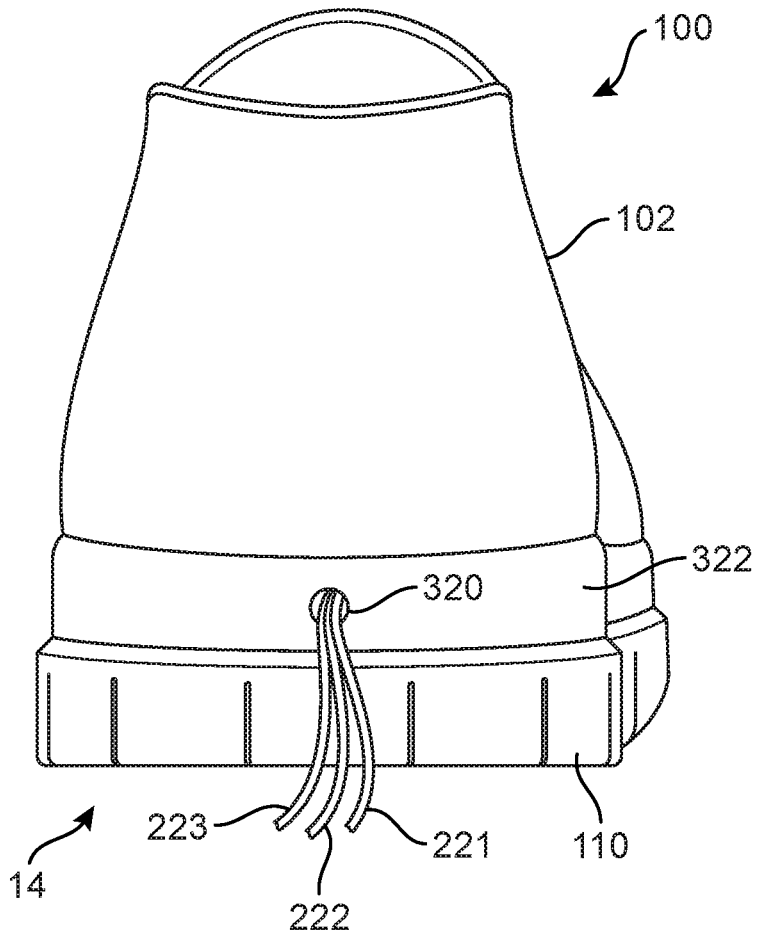
FIG. 4 is a schematic rear view of the article of footwear of FIG. 1.

In some embodiments, sole structure 110 may include provisions that facilitate the entrance and/or exit of tensioning members from sole structure 110. For example, in some embodiments, sole structure 110 may include one or more side cutouts that allow tensioning members to enter branching side channels along a side edge of sole structure 110. In an exemplary embodiment, sole structure 110 may include first side cutout 341, second side cutout 342 and third side cutout 343 corresponding to first branching side channel 301, second branching side channel 302 and third branching side channel 303, respectively. In addition, in some embodiments, sole structure 110 may be provided with a rear opening 320 that provides access to central longitudinal channel 305 from rearward peripheral wall 322 of sole structure 110 (see FIG. 4).

As shown in FIG. 3, an inner member 103 may be used in some embodiments. Inner member 103 is depicted as an insole in the exemplary embodiment. However, in other embodiments, inner member 103 could comprise a strobel liner, lasting board and/or similar structure associated with either upper 102 or sole structure 110. Although some embodiments include an inner member 103, in other embodiments an inner member may be optional. In another embodiment, for example, a user's foot may rest directly on proximal surface 155 of sole structure 110.

Figure 5:
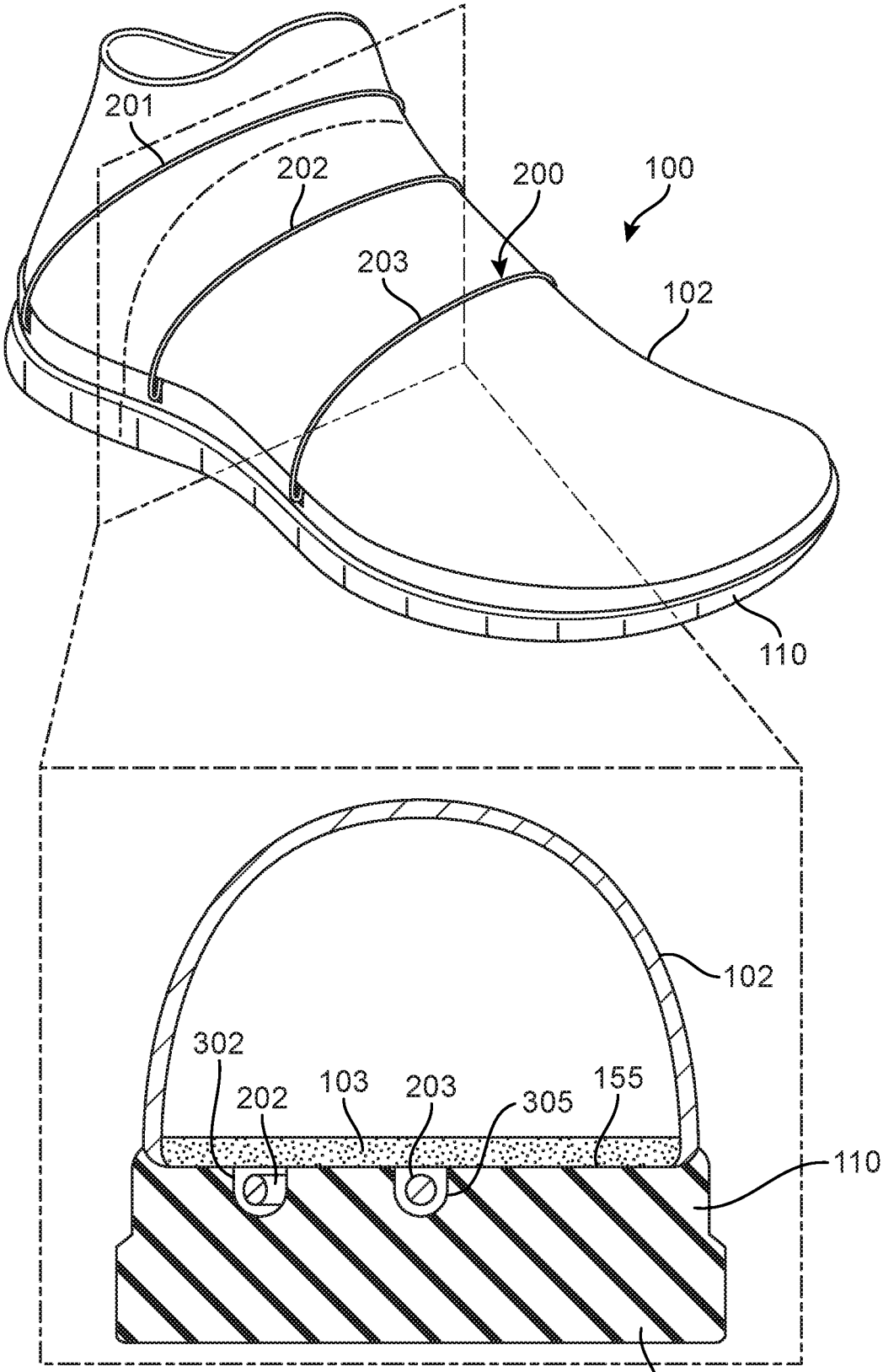
FIG. 5 is a schematic isometric view of an embodiment of an article of footwear and an enlarged schematic cross-sectional view of a portion of the article of footwear.

FIG. 5 illustrates an isometric view of an embodiment of article 100, including an enlarged schematic cross-sectional view of a portion of article 100. Referring to FIG. 5, second tensioning member 202 is disposed within second branching side channel 302. In this cross-sectional view, a portion of third tensioning member 203 is also seen disposed within central longitudinal channel 305. Moreover, inner member 103 is disposed on proximal surface 155 of sole structure 110 and covers the open channel configuration. With this configuration, a user's foot, when inserted into upper 102, may rest on inner member 103. This arrangement helps prevent direct contact between a user's foot and the channels or tensioning members.

Figure 6:
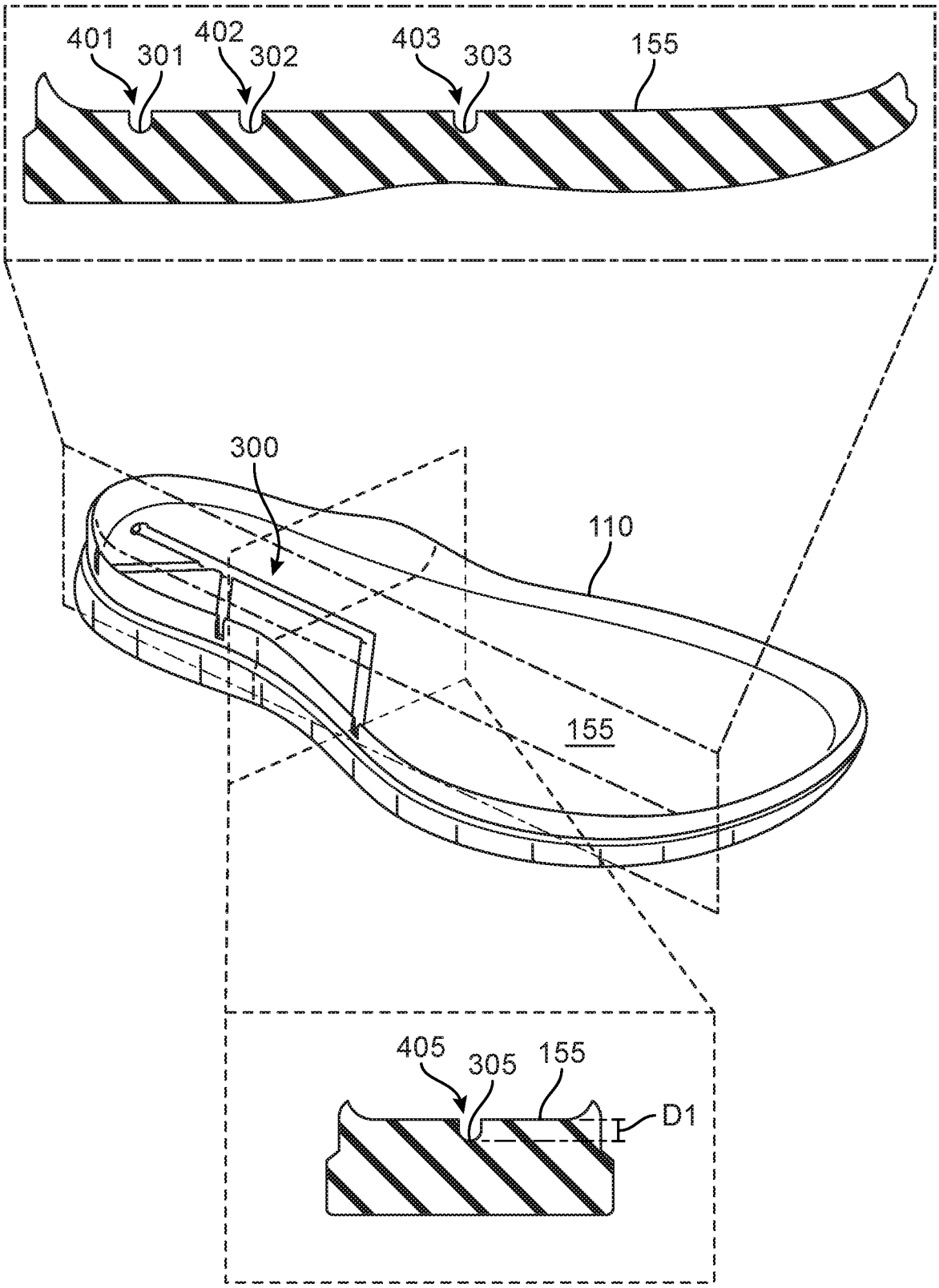
FIG. 6 is a schematic isometric view of an embodiment of a sole structure and two enlarged cross-sectional views of portions of the sole structure.

FIG. 6 is a schematic isometric view of an embodiment of sole structure 110, including a first cross-sectional view of the sole structure taken along a longitudinal direction and a second cross-sectional view of the sole structure taken along a lateral direction. Referring to FIG. 6, some embodiments may be configured with an open channel configuration. In other words, one or more channels in set of channels 300 may be open on a surface of sole structure 110, rather than being completely enclosed within the outer surfaces of sole structure 110. In an exemplary embodiment, each channel may be open on proximal surface 155 of sole structure 110. For example, central longitudinal channel 305 includes an upper open portion 405 that is in fluid communication with proximal surface 155. Likewise, first branching side channel 301 includes an upper open portion 401 that is in fluid communication with proximal surface 155. Further, second branching side channel 302 includes an upper open portion 402 that is in fluid communication with proximal surface 155. Still further, third branching side channel 303 includes an upper open portion 403 that is in fluid communication with proximal surface 155. With this arrangement, tensioning members disposed within set of channels 300 may be visible on proximal surface 155 of sole structure 110.

In still other embodiments, portions of one or more channels could be closed on a proximal surface of a sole structure. In some embodiments, for example, channels may be enclosed on all sides within the interior of the sole structure.

In an exemplary embodiment, each channel of set of channels 300 may be open (i.e., open on proximal surface 155) along a majority of the length of channels 300. For example, in some embodiments, each channel may be open along at least 50 percent of the length of the channel. This open channel configuration may facilitate assembly by allowing the tensioning members to be inserted directly into the channels, rather than requiring them to be threaded through closed channels. Such a configuration may also make it easier to access the tensioning members should the tensioning members require adjustment and/or replacement.

Figure 7:
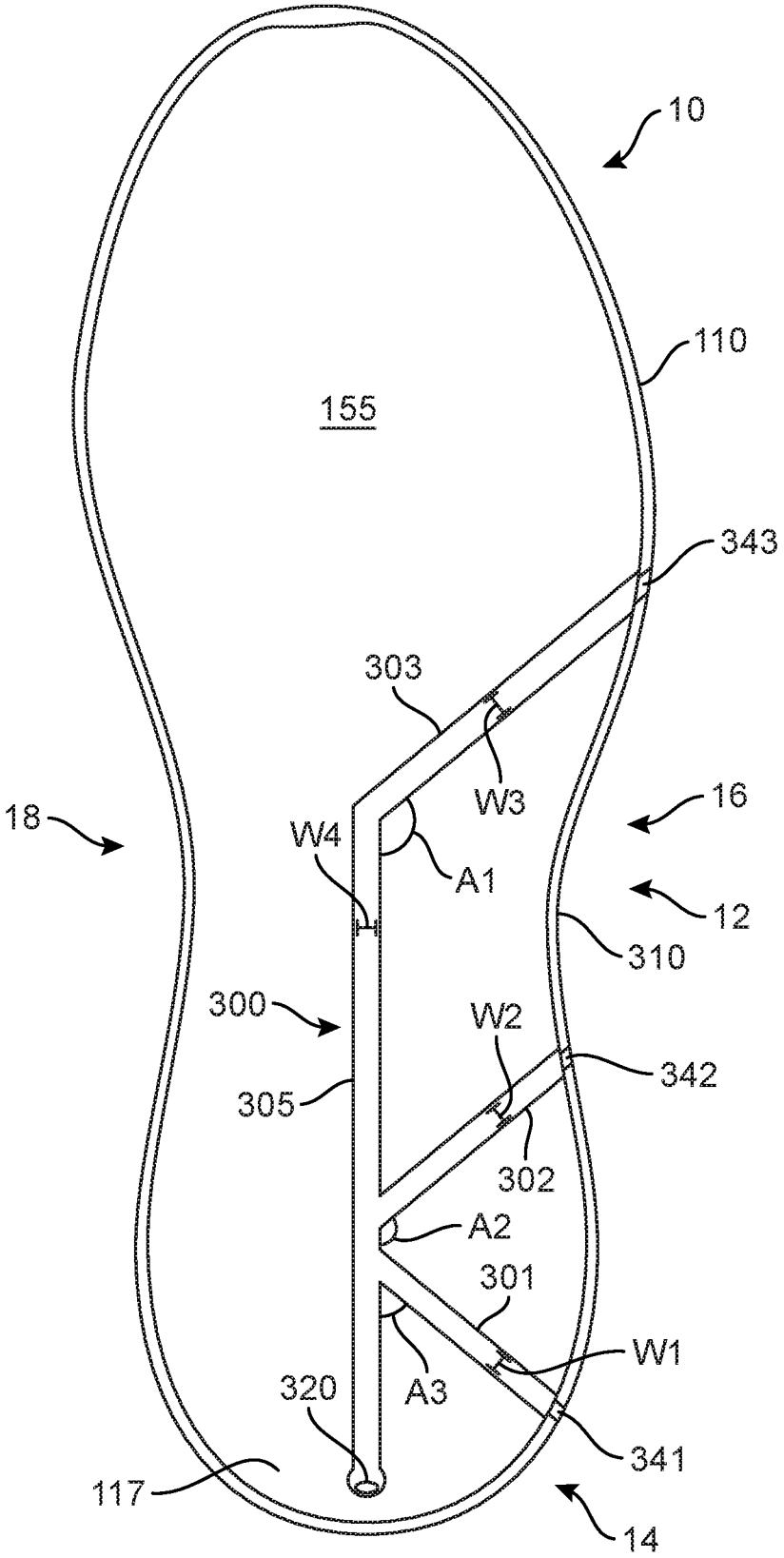
FIG. 7 is a top down view of an embodiment of a sole structure.

FIG. 7 is a schematic top down view of an embodiment of sole structure 110, in which proximal surface 155 is clearly visible. The general configuration of channels within sole structure 110, including their general locations and general orientations are clearly shown in FIG. 7.

Generally, the locations of one or more channels can vary from one embodiment to another. In some embodiments, one or more channels may be disposed in forefoot portion 10, midfoot portion 12 and/or heel portion 14 of sole structure 110. Moreover, some channels may be disposed in a lateral side 16 and/or a medial side 18 of sole structure 110. In an exemplary embodiment, central longitudinal channel 305 may be located approximately in the middle of sole structure 110. In other cases, however, central longitudinal channel could be offset towards the lateral or medial sides. Furthermore, central longitudinal channel 305 may extend forwardly from a rear end portion 117 of sole structure 110. In some embodiments, central longitudinal channel 305 extends through heel portion 14 and midfoot portion 12, and may not extend into forefoot portion 10 (or may extend only partially into forefoot portion 10).

In some embodiments, each branching side channel may generally extend from central longitudinal channel 305 to lateral side edge 310 of sole structure 110. In some embodiments, first branching side channel 301 and second branching side channel 302 may extend through heel portion 14 along lateral side 16. In some embodiments, third branching side channel 303 may extend through midfoot portion 12 and forefoot portion 10, and along lateral side 16.

In different embodiments, the orientations of each channel could vary. For example, in some embodiments, central longitudinal channel 305 may extend in an approximately longitudinal direction with respect to sole structure 110. However, in other embodiments, central longitudinal channel 305 could be angled with respect to the longitudinal direction. In addition, each branching side channel may extend at an angle from central longitudinal channel 305. In an exemplary embodiment, first branching side channel 301 forms an angle A3 with central longitudinal channel 305, second branching side channel 302 forms an angle A2 with central longitudinal side channel 305, while third branching side channel 303 forms an angle A1 with respect to central longitudinal channel 305.

The values of angle A1, angle A2 and angle A3 can vary. In one exemplary embodiment, angle A1 may have a value greater than 90 degrees such that third branching side channel 303 extends diagonally from central longitudinal channel 305 to lateral side edge 310. Specifically, third branching side channel 303 may extend in a diagonally forward direction, or towards forefoot portion 10. Additionally, in an exemplary embodiment, angle A2 may have a value greater than 90 degrees such that second branching side channel 302 extends diagonally from central longitudinal channel 305 to lateral side edge 310. Specifically, second branching side channel 302 may extend in a diagonally forward direction. In some cases, second branching side channel 302 may be approximately parallel with third branching side channel 303. In addition, in an exemplary embodiment, angle A3 may have a value less than 90 degrees such that first branching side channel 301 extends diagonally from central longitudinal channel to lateral side edge 310. However, in contrast to second branching side channel 302 and third branching side channel 303, first branching side channel 301 may extend diagonally and rearwardly, or towards rear end portion 117 of sole structure 110. In other words, in some embodiments, first branching side channel 301 may be rotated with respect to second branching side channel 302 and third branching side channel 303. This angled configuration for each branching side channel may help in controlling tension and travel of each tensioning member.

In still other embodiments, angle A1, angle A2 and angle A3 could have any other values. In an alternative embodiment, for example, one or more angles could be 90 degree angles, such that one or more branching side channels are approximately perpendicular to central longitudinal channel. In such cases, one or more branching side channels may extend approximately in the lateral direction, rather than in a diagonal direction.

In different embodiments, the geometry of one or more channels could vary. In some embodiments, channels may have an approximately linear geometry. For example, when considered in isolation, in some embodiments, central longitudinal channel 305, first branching side channel 301, second branching side channel 302 and third branching side channel 303 all have approximately straight or linear geometries. However, in other embodiments, one or more channels could have nonlinear geometries. For example, in some cases, channels can have a generally wavy shape. In other cases, channels can be arranged in any other nonlinear configuration. It will be understood that the term "nonlinear configuration" is not intended to be limited to a particular type of nonlinear shape or arrangement. For example, a nonlinear configuration for a channel can include smooth nonlinear shapes such as sinusoidal shapes, wavy shapes, as well as other smooth nonlinear shapes. Also, a nonlinear configuration for a channel can include polygonal nonlinear shapes with edges such as zig-zag shapes, triangle wave shapes, square wave shapes, as well as any other types of non-smooth nonlinear shapes.

Figure 8:
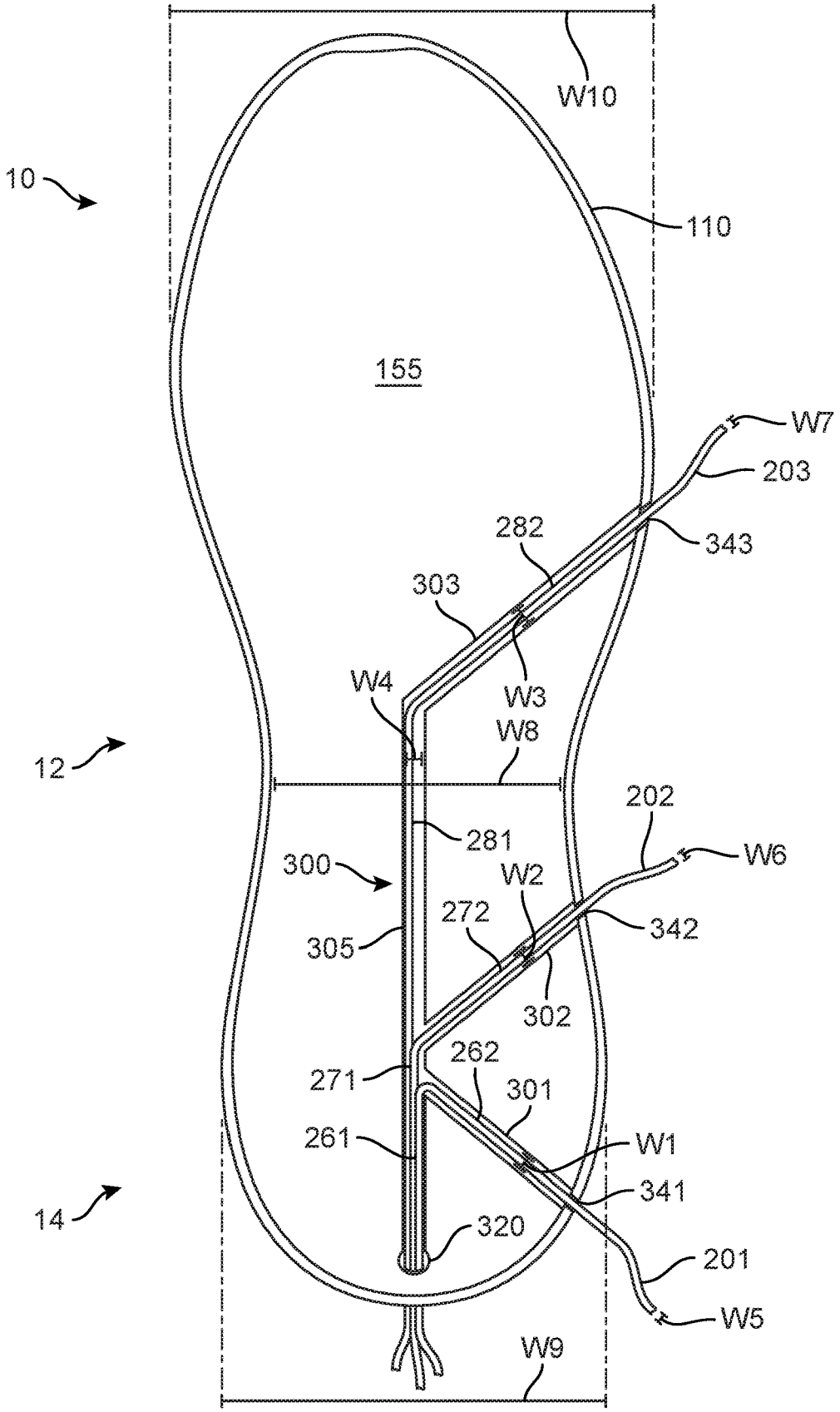
FIG. 8 is a top down view of an embodiment of a sole structure, in which tensioning members are disposed within channels of the sole structure.

The arrangement of tensioning members throughout article 100, including their arrangement within set of channels 300, is clearly shown in FIG. 8. For example, first tensioning member 201 enters sole structure 110 through rear opening 320. From rear opening 320, a first portion 261 of first tensioning member 201 extends through central longitudinal channel 305 until first tensioning member 201 enters first branching side channel 301. A second portion 262 of first tensioning member 201 extends through first branching side channel 301 and exits at first side cutout 341. Similarly, second tensioning member 202 enters sole structure 110 through rear opening 320. From rear opening 320, a first portion 271 of second tensioning member 202 extends through central longitudinal channel 305 until second tensioning member 202 enters second branching side channel 302. A second portion 272 of second tensioning member 202 extends through second branching side channel 302 and exits at second side cutout 342. Also, third tensioning member 203 enters sole structure 110 through rear opening 320. From rear opening 320, a first portion 281 of third tensioning member 203 extends through central longitudinal channel 305 until third tensioning member 203 enters third branching side channel 303. A second portion 282 of third tensioning member 203 extends through third branching side channel 303 and exits at third side cutout 343.

The widthwise dimensions of various components associated with article 100 may be clearly seen in FIGS. 7 and 8. For purposes of reference, each channel is associated with a width. It is to be understood that the widths discussed here and shown in the figures are intended to be representative, and in some cases average, widths. Thus, although the width of each channel may vary over the length of the channel, each channel may still be characterized by an average width. Similarly, each tensioning member may be associated with a width. The widths associated with each tensioning member may be likewise representative, and in some cases average, widths.

Referring to FIGS. 7 and 8, first branching side channel 301 has a width W1, second branching side channel 302 has a width W2, third side branch channel 303 has a width W3 and central longitudinal channel 305 has a width W4. As clearly seen in FIG. 7, the widths of each branching side channel (e.g., width W1, width W2 and width W3) may be approximately similar to width W4 of central longitudinal channel 305. For example, in some embodiments, the value of width W4 may be less than three times the value of width W1. In other words, in some embodiments, central longitudinal channel 305 may be less than three times as wide as first branching side channel 301. Similarly, in some cases, the ratio of width W4 to width W2 may also be 3 or less. Likewise, in some cases, the ratio of width W4 to width W3 may be 3 or less. In still other embodiments, the ratio of width W4 to width W1 may range between 0.5 and 1.5. In still other embodiments, the ratio of width W4 to width W1 may range between 0.9 and 1.1. Moreover, the ratios of width W4 to width W2 and to width W3 could likewise vary in similar ranges.

In some embodiments, width W4 could be approximately equal to width W1, width W2 and/or width W3. By maintaining relatively similar widths for each channel, the travel of each tensioning member may be better controlled and therefore tension control for the article can be enhanced. Of course, in other embodiments it is possible that width W4 could be three or more times larger than either of width W1, width W2 or width W3.

In some embodiments, the width of central longitudinal channel 305 may be substantially narrow compared to the width of article 100. Specifically, in some cases, the width of central longitudinal channel 305 may be wide enough to accommodate multiple tensioning members, but may be substantially less than the average width, or even the minimal width, of sole structure 110.

As seen in FIG. 8, each tensioning member is associated with a width. For example, first tensioning member 201 has a width W5. Likewise, second tensioning member 202 has a width W6, while third tensioning member 203 has a width W7. In some embodiments, the values of width W5, width W6 and width W7 may be substantially similar. In other embodiments, however, each width could be different.

As clearly shown in FIG. 8, each channel may be sized to fit at least one tensioning member. However, the width of each channel may not be substantially greater than the widths of the tensioning members (e.g., more than a few times the width of a tensioning member). For example, in some cases, width W1 of first branching side channel 301 may be only slightly larger (e.g., 2-3 times larger) than width W5 of first tensioning member 201. Likewise, width W2 of second branching side channel 302 and width W3 of third branching side channel 303 may be only slightly larger than the widths of second tensioning member 202 and third tensioning member 203 (that is, width W6 and width W7, respectively).

Moreover, as clearly shown in FIG. 8, in an exemplary embodiment, width W4 of central longitudinal channel 305 may be large enough to accommodate first tensioning member 201, second tensioning member 202 and third tensioning member 203 simultaneously. However, in some cases, width W4 may not be significantly larger than 2-4 times the width of each individual tensioning member.

For purposes of characterizing the relative width of central longitudinal channel 305 and sole structure 110, sole structure 110 is depicted as having a minimal width W8, which may be associated with midfoot portion 12 and/or forefoot portion 10 of sole structure 110. Additionally, sole structure 110 has a maximal heel width W9 at heel portion 14 and a maximal forefoot width W10 at forefoot portion 10.

In some embodiments, width W4 of central longitudinal channel 305 may be substantially less than the width of sole structure 110. Specifically, width W4 may be less than the minimal width W8 of sole structure 110, and may therefore also be substantially less than width W9 at heel portion 14 and width W10 at forefoot portion 10. To appreciate the relative difference between width W4 of central longitudinal channel 305 and the minimal width W8 of sole structure 110, the ratios of several widths may be compared. For example, in some embodiments, the ratio of width W4 of central longitudinal channel 305 to width W7 of first tensioning member 201 may be substantially smaller than the ratio of width W8 of sole structure 110 to width W7. In other words, width W8 of sole structure 110 may be many times greater than width W7 of first tensioning member 201, while width W4 of central longitudinal channel 305 may only be slightly larger than width W7 of first tensioning member 201. Thus, in some cases, while the ratio of width W4 to width W7 may be in the range between 1 to 5 (e.g., width W4 is 1 to 5 times larger than width W7), the ratio of width W8 to width W7 may be in the range between 10-100, or possibly even greater.

It may therefore be seen that central longitudinal channel 305 comprises a relatively narrow channel, when compared to the overall width of sole structure 110. This allows the arrangement of each tensioning member to be carefully controlled within central longitudinal channel 305, to facilitate smooth travel and enhance tension. This arrangement may be in contrast to some other embodiments where tensioning members may extend through a hollow central cavity that extends through much of sole structure 110. Such embodiments may require additional features, such as guides, pulleys or other devices, to maintain tension along the tensioning members and ensure the tensioning members are maintained in a desired configuration within sole structure 110.

In different embodiments, the depth of each channel can vary. In some embodiments, one or more channels may have a depth that, as measured from proximal surface 155, is large enough to accommodate a tensioning member. For example, referring to FIG. 6, central longitudinal channel 305 may have an approximate depth D1. In some embodiments, depth D1 may be greater than or equal to width W1, width W2 or width W3 of first branching side channel 301, second branching side channel 302 or third branching side channel 303, respectively. In other embodiments, depth D1 could be less than these widths. In still other cases, depth D1 may be significantly larger than any of these widths—for example, 5 or more times the size of the widths of the tensioning members.

Figure 9:
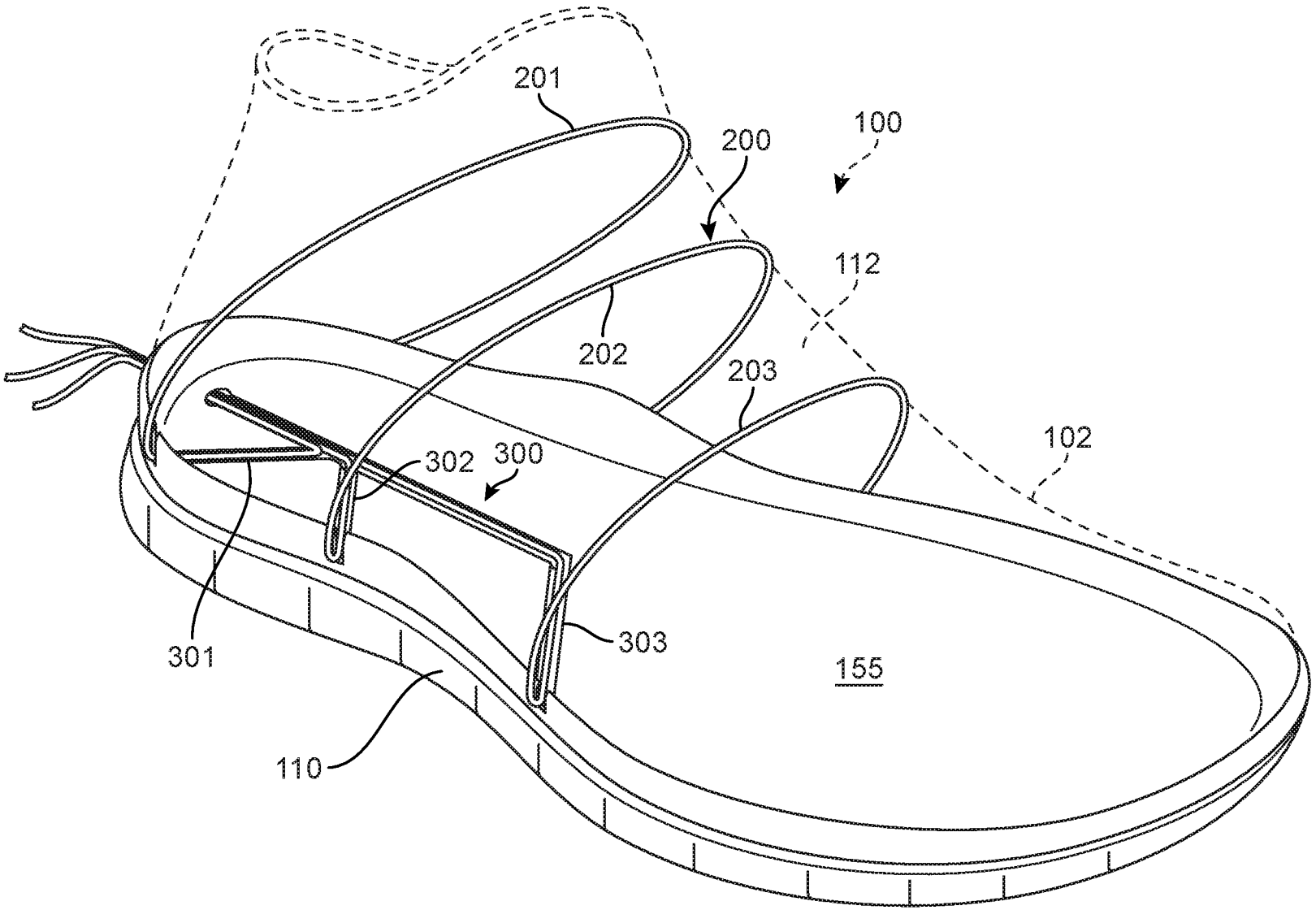
FIG. 9 is a schematic isometric view of an embodiment of an article of footwear in a loosened state.
Figure 10:
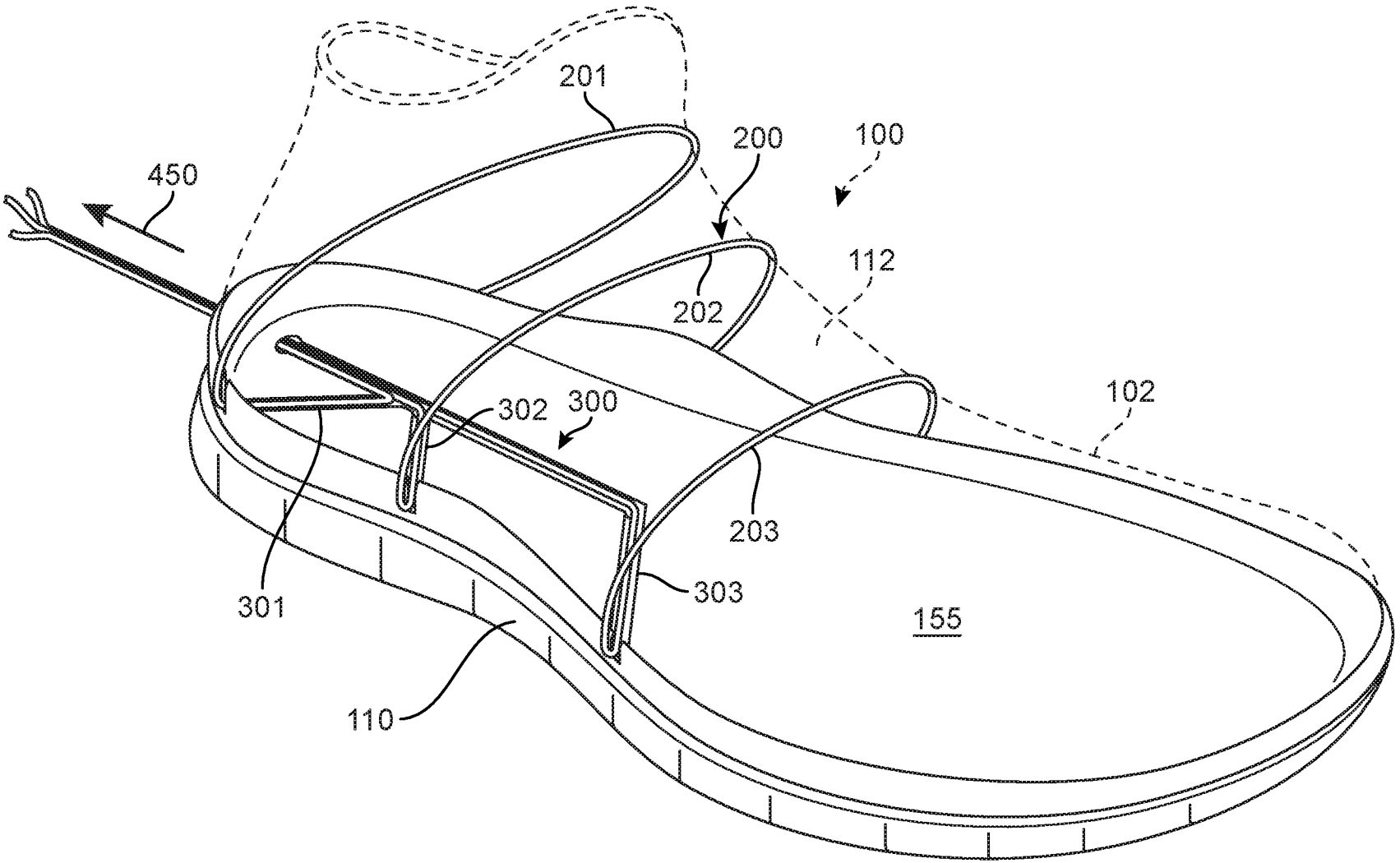
FIG. 10 is a schematic isometric view of an embodiment of an article of footwear in a tightened state.

FIGS. 9 and 10 illustrate schematic isometric views of article 100, in which upper 102 is shown in phantom. Specifically, FIG. 9 depicts a configuration in which set of tensioning members 200 is loose, so that little to no tension is applied across upper 102, especially at instep portion 112. In contrast, FIG. 10 depicts a configuration where a tension 450 has been applied to the ends of set of tensioning members 200, which are disposed outwardly and behind sole structure 110. As tension 450 is applied, first tensioning member 201, second tensioning member 202 and third tensioning member 203 are all pulled through set of channels 300. Additionally, the portions of first tensioning member 201, second tensioning member 202 and third tensioning member 203 that are disposed across upper 102 are pulled taut, especially at instep portion 112, thus acting to contract the volume of upper 102 around a foot.

Figure 11:
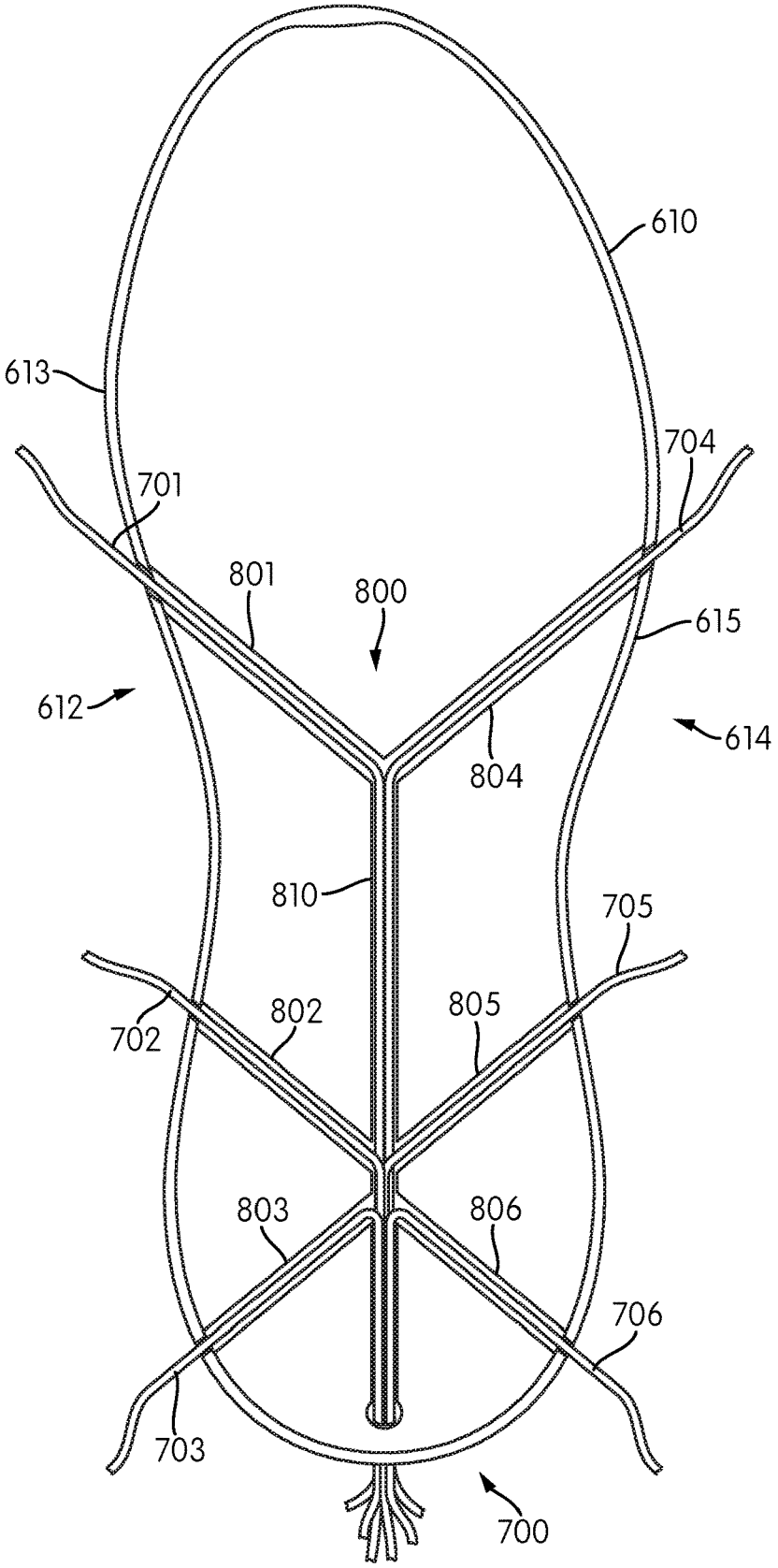
FIG. 11 is a top down schematic view of another embodiment of a sole structure with tensioning members.
Figure 12:
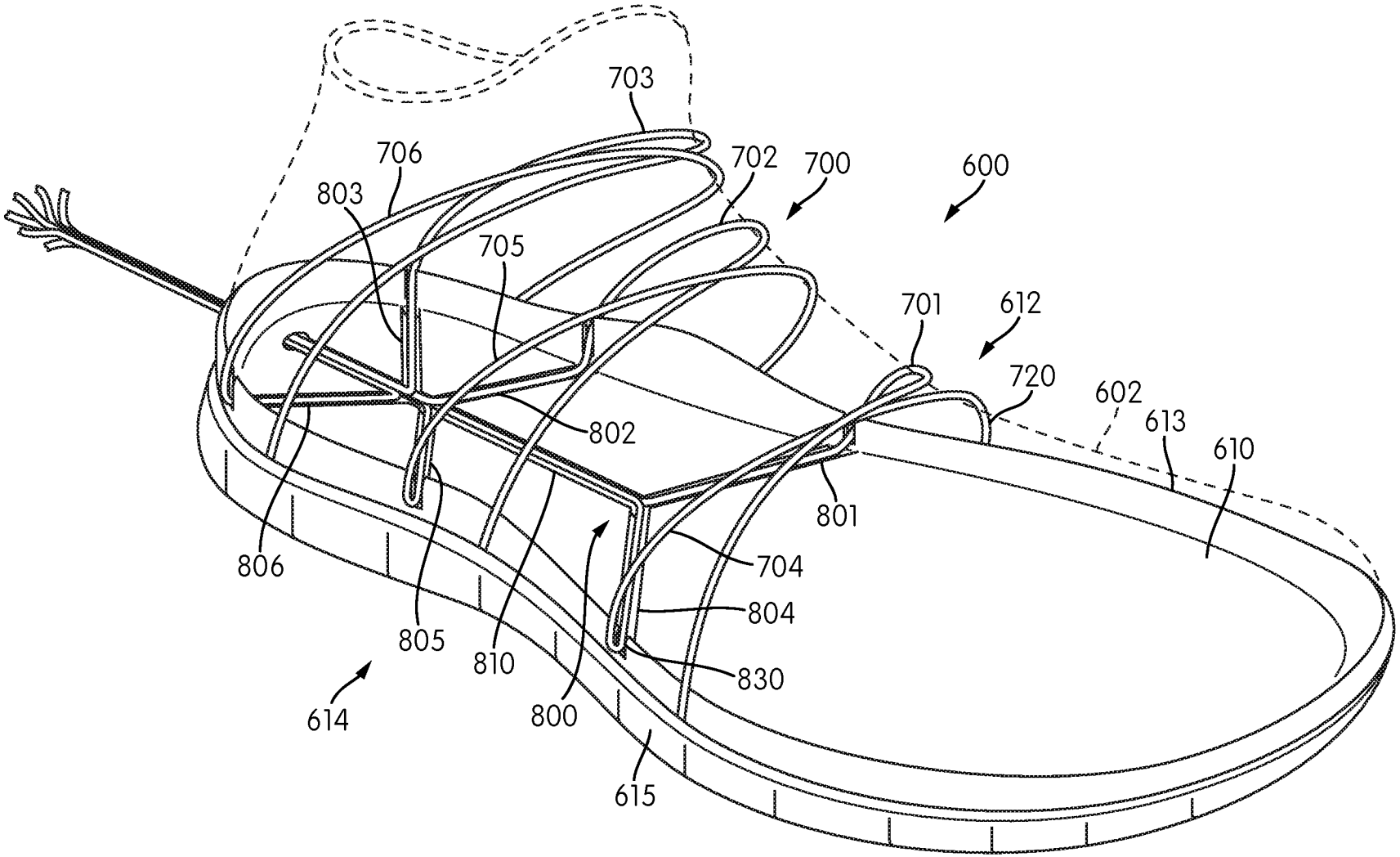
FIG. 12 is a schematic isometric view of another embodiment of an article of footwear with a tensioning system.

FIGS. 11-12 illustrate another embodiment of an article of footwear 600 that incorporates a plurality of tensioning members 700 of a tensioning system. Specifically, FIG. 11 illustrates a top down view of an embodiment of a sole structure 610 that incorporates various tensioning members, while FIG. 12 illustrates an isometric view of article 600, including sole structure 610 and upper 602, where upper 602 shown in phantom for purposes of illustration.

Referring to FIGS. 11-12, sole structure 610 may be configured with a plurality of channels 800, including first branching side channel 801, second branching side channel 802, third branching side channel 803, fourth branching side channel 804, fifth branching side channel 805 and sixth branching side channel 806. Plurality of channels 800 may further include central longitudinal channel 810. In contrast to some previous embodiments where branching side channels extend only on one side of the sole structure, the embodiment of FIGS. 11-12 is seen to have branching side channels that extend on both a lateral side 614 and a medial side 612 of article 600. Specifically, first branching side channel 801, second branching side channel 802 and third branching side channel 803 extend on medial side 612 between central longitudinal channel 810 and medial side edge 613, while fourth branching side channel 804, fifth branching side channel 805 and sixth branching side channel 806 extend on lateral side 614 between central longitudinal channel 810 and lateral side edge 615.

In some embodiments, plurality of channels 800 may each receive a distinct tensioning member, where each tensioning member extends along central longitudinal channel 810 to a particular branching side channel. For example, in the exemplary embodiment, first tensioning member 701 extends from central longitudinal channel 810, through first branching side channel 801 and out of medial side edge 613 of sole structure 610. Likewise, a second tensioning member 702 is associated with second branching side channel 802, a third tensioning member 703 is associated with a third branching side channel 803, a fourth tensioning member 704 is associated with a fourth branching side channel 804, a fifth tensioning member 705 is associated with a fifth branching side channel 805 and a sixth tensioning member 706 is associated with a sixth branching side channel 806.

In at least some embodiments, each branching side channel on one side of sole structure 610 may be arranged in an approximately symmetric manner about central longitudinal channel 810 with a corresponding branching side channel. For example, first branching side channel 801 may be arranged in an approximately symmetric manner (about central longitudinal channel 810) with fourth branching side channel 804. Similarly, second branching side channel 802 may be arranged in an approximately symmetric manner (about central longitudinal channel 810) with fifth branching side channel 805. Also, third branching side channel 803 may be arranged in an approximately symmetric manner (about central longitudinal channel 810) with sixth branching side channel 806. This approximately symmetric arrangement for plurality of channels 800 and the corresponding symmetric arrangement of plurality of tensioning members 700 may result in even tensioning, or pull, over upper 602 on both medial side 612 and lateral side 614.

As shown in FIG. 12, each tensioning member may extend form an opening on a sidewall of sole structure 610, wrap over upper 602 and then may be fixedly attached to upper 602 and/or sole structure 610 on a side opposite of where the tensioning member exited sole structure 610. As one example, fourth tensioning member 704 is seen to exit fourth branching side channel 804 of sole structure 610 at opening 830 on lateral side 614. From opening 830, a portion of fourth tensioning member 704 extends over upper 602. An end portion 720 of fourth tensioning member 704 may be further secured to article 600 on medial side 612.

The end portions of a tensioning member may be secured to any portion of article 600. For example, end portion 720 may be secured either to sole structure 610 or to upper 602. Moreover, end portion 720 could be secured using stitches, staples, adhesives or any other kind of fasteners. In a similar manner, each of the end portions of the remaining tensioning members of plurality of tensioning members 700 could be secured to any portion of article 600 using any known attachment method.

The exemplary embodiment depicted in FIGS. 11-12 shows a separate tensioning member extending through each branching side channel of sole structure 610, and across upper 602. In still other embodiments, however, it is possible that a single tensioning member could exit a channel of sole structure 610 on one side of article 600 and then re-enter a channel of sole structure 610 on an opposing side of article 600. For example, in another embodiment, a tensioning member could extend through first branching side channel 801, out of sole structure 610 and around upper 602, and then back into sole structure 610 through fourth branching side channel 804. Such a looped configuration may help to balance tension across the medial and lateral sides of upper 602.

In different, the positioning or arrangement of tensioning members on the surface of upper 602 could vary. For example, in a previous embodiment depicted clearly in FIG. 9, three different tensioning members are seen to extend around upper 102 in an approximately parallel configuration, with each tensioning member primarily traveling from the lateral to medial side of upper 102. In contrast, as clearly shown in FIG. 12, some embodiments may have tensioning members that crisscross or otherwise run both laterally and longitudinally along the surface of upper 602. By providing different arrangements of tensioning members on upper 602, the tension applied to different regions of upper 602 by plurality of tensioning members 700 can be varied.

Figure 13:
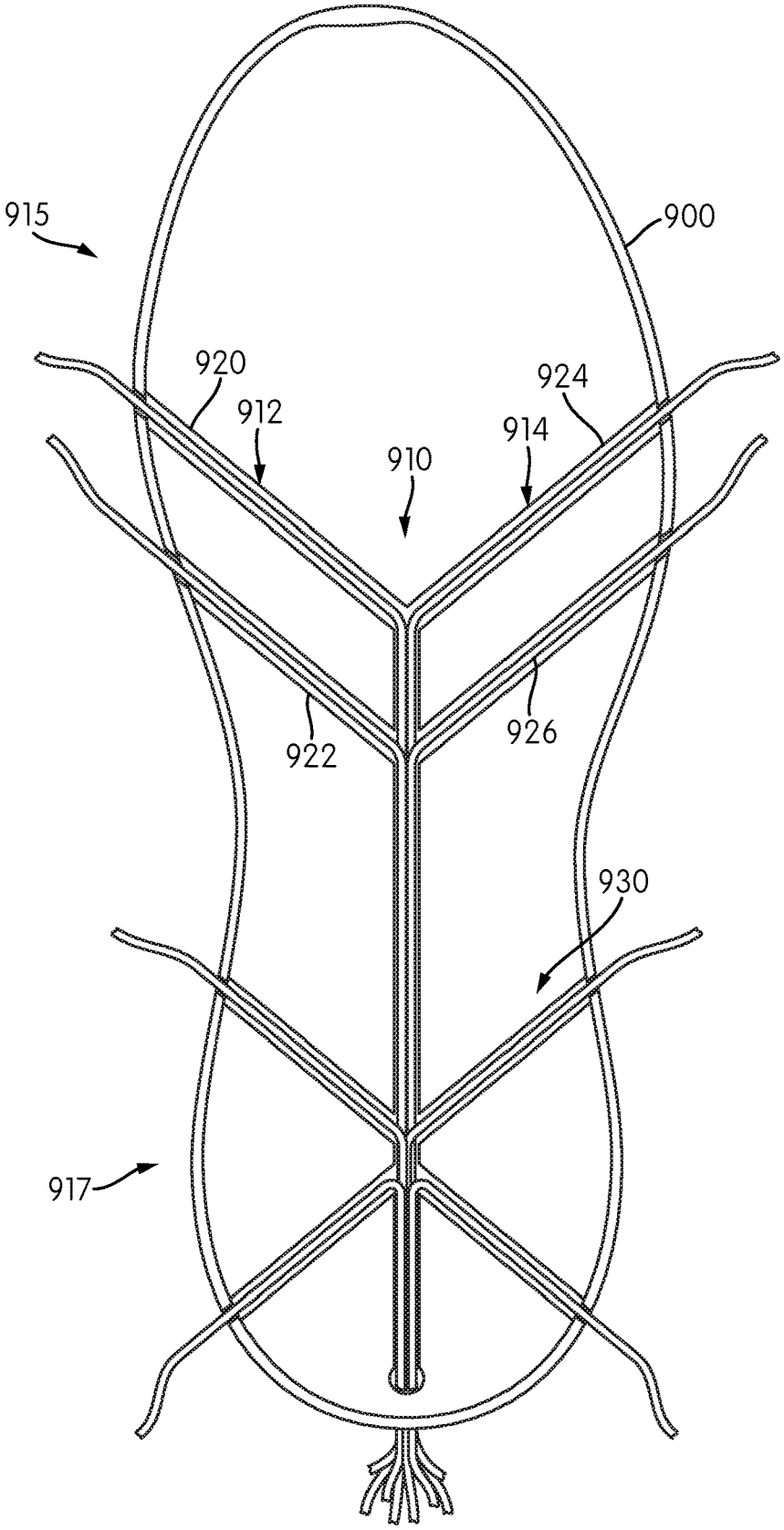
FIG. 13 is a top down schematic view of an embodiment of a sole structure with eight branching side channels arranged in a symmetric manner.

It will be understood that the number of branching side channels can vary in other embodiments. For example, while the embodiment shown in FIGS. 11-12 includes six total branching side channels, other embodiments could incorporate any number less than six or greater than six. For example, FIG. 13 illustrates a top down schematic view of a sole structure 900 that incorporates eight branching side channels. Specifically, plurality of branching side channels 910 include a first set of branching side channels 912 and a second set of branching side channels 914, which both extend through forefoot portion 915 of sole structure 900. Here, first set of branching side channels 912 includes branching side channel 920 and branching side channel 922, while second set of branching side channels 914 includes branching side channel 926 and branching side channel 928. Sole structure 900 further includes a third set of branching side channels 930, including four different branching side channels that extend through heel portion 917 of sole structure 900.

Figure 14:
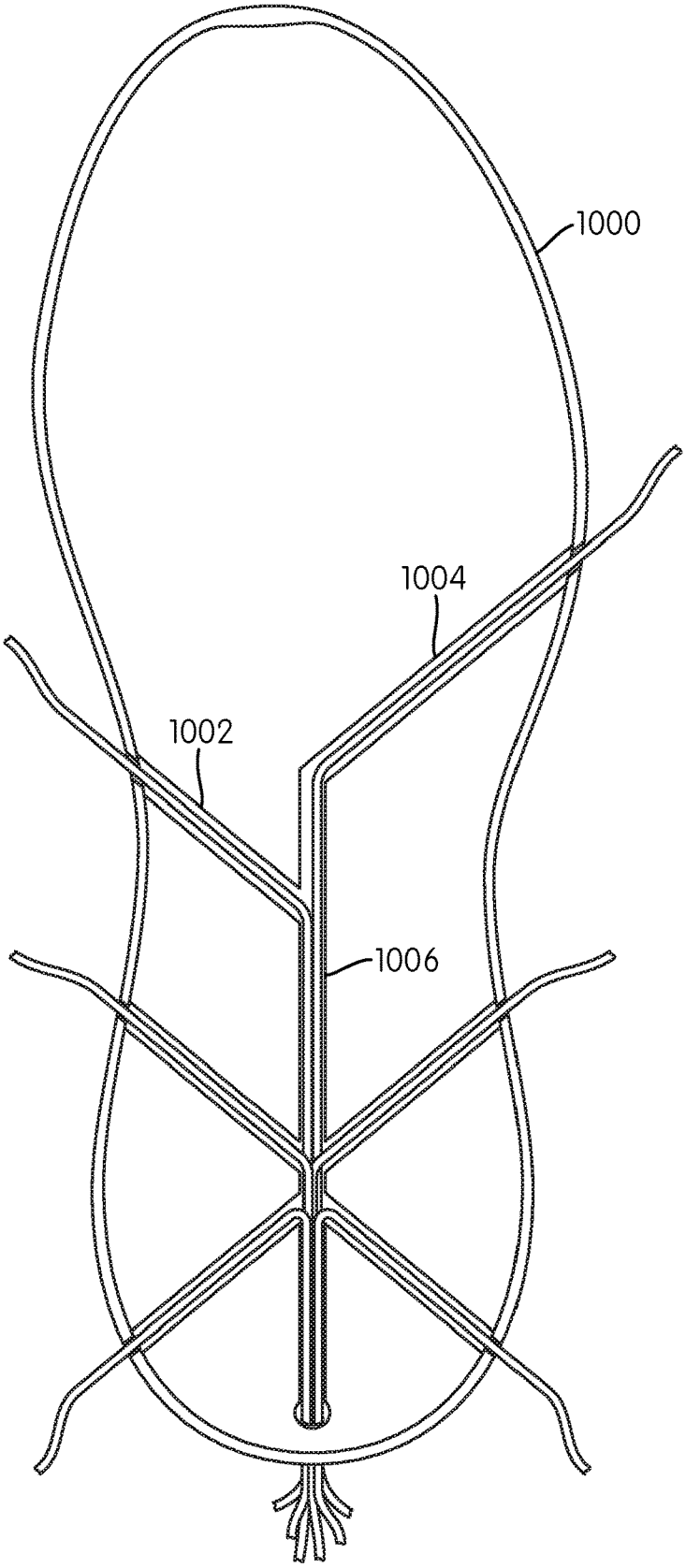
FIG. 14 is a top down schematic view of an embodiment of a sole structure with an asymmetric branching side channel configuration.

In still another embodiment, shown in FIG. 14, a sole structure 1000 may be configured with six total branching side channels, but where the configuration of branching side channels is asymmetric. Specifically, in the embodiment depicted in FIG. 14, a first branching side channel 1002 is arranged in an asymmetric manner with respect to a second branching side channel 1004 (about central longitudinal channel 1006). The use of asymmetric configurations of branching side channels with respect to the medial and lateral sides of an article may allow for variations in tension on the medial and lateral sides of an upper.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper;

a sole structure including a distal surface and a proximal surface, wherein the proximal surface is disposed closer to the upper than the distal surface;

a central cavity formed in the sole structure and having an anterior-posterior axis;

a first branching side channel formed in the proximal surface such that it is located within the sole structure, and extending from the central cavity to a medial side edge of the sole structure;

a first tensioning member extending from the central cavity, through the first branching side channel, and along a portion of a medial side of the upper;

a second branching side channel formed in the proximal surface such that it is located within the sole structure, and extending from the central cavity to a lateral side edge of the sole structure;

a second tensioning member extending from the central cavity, through the second branching side channel, and along a portion of a lateral side of the upper;

a rear opening formed in a heel portion of the sole structure and in fluid communication with the central cavity;

a third tensioning member extending from the central cavity, through the rear opening, and along a rear side of the upper;

a plurality of medial branching side channels extending from the central cavity toward the medial side edge of the sole structure;

a plurality of medial tensioning members, each medial tensioning member extending from the central cavity, through one of the medial branching side channels, and along a portion of the medial side of the upper;

a plurality of lateral branching side channels extending from the central cavity toward the lateral side edge of the sole structure; and a plurality of lateral tensioning members, each lateral tensioning member extending from the central cavity, through one of the lateral branching side channels, and along a portion of the lateral side of the upper.

2. The article of footwear according to claim 1, wherein the first branching side channel forms a first angle with the anterior-posterior axis, wherein the second branching side channel forms a second angle with the anterior-posterior axis, and wherein each of the first angle and the second angle is substantially greater than 0 degrees and substantially less than 180 degrees.

3. The article of footwear according to claim 2, wherein the first angle is approximately equal to the second angle.

4. The article of footwear according to claim 2, wherein the first angle is different than the second angle.

5. An article of footwear, comprising:

an upper;

a sole structure including a distal surface and a proximal surface, wherein the proximal surface is disposed closer to the upper than the distal surface;

a central cavity formed in the sole structure and having an anterior-posterior axis;

a first branching side channel formed in the proximal surface such that it is located within the sole structure, and extending from the central cavity to a medial side edge of the sole structure;

a first tensioning member extending from the central cavity, through the first branching side channel, and along a portion of a medial side of the upper;

a second branching side channel formed in the proximal surface such that it is located within the sole structure, and extending from the central cavity to a lateral side edge of the sole structure;

a second tensioning member extending from the central cavity, through the second branching side channel, and along a portion of a lateral side of the upper;

a rear opening formed in a heel portion of the sole structure and in fluid communication with the central cavity;

a third tensioning member extending from the central cavity, through the rear opening, and along a rear side of the upper;

a first additional branching side channel extending from the central cavity toward the medial side edge of the sole structure;

a fourth tensioning member extending from the central cavity, through the first additional branching side channel, and along a portion of the medial side of the upper;

a second additional branching side channel extending from the central cavity toward the lateral side edge of the sole structure; and a fifth tensioning member extending from the central cavity, through the second additional branching side channel, and along a portion of the lateral side of the upper.

6. The article of footwear of claim 5, wherein the first additional branching side channel forms an angle with the anterior-posterior axis that is the same as the first angle, and the second additional branching side channel forms an angle with the anterior-posterior axis that is the same as the second angle.

7. The article of footwear of claim 5, wherein the first additional branching side channel forms an angle with the anterior-posterior axis that is different than the first angle, and the second additional branching side channel forms an angle with the anterior-posterior axis that is different than the second angle.

8. The article of footwear according to claim 1, wherein at least one medial branching side channel forms an angle with the anterior-posterior axis that is the same as the first angle.

9. The article of footwear according to claim 1, wherein at least one medial branching side channel forms an angle with the anterior-posterior axis that is different than the first angle.

10. The article of footwear according to claim 1, wherein at least one lateral branching side channel forms an angle with the anterior-posterior axis that is the same as the second angle.

11. The article of footwear according to claim 1, wherein at least one lateral branching side channel forms an angle with the longitudinal axis that is different than the second angle.

12. The article of footwear according to claim 1, wherein the central cavity, the first branching side channel, and the second branching side channel are open on the proximal surface of the sole structure.

13. The article of footwear according to claim 1, wherein at least a portion of each of the first branching side channel and the second branching side channel have depths that are substantially equal to a depth of the central cavity, and wherein the depths of each of the first branching side channel, the second branching side channel, and the central cavity are measured from the proximal surface of the sole structure.

14. The article of footwear according to claim 1, wherein the first tensioning member and the second tensioning member are tensioned using a motorized tensioning device.

15. The article of footwear according to claim 1, wherein the first tensioning member and the second tensioning member are tensioned using a manually actuated tensioning device.

16. The article of footwear of claim 1, wherein the article of footwear is configured such that a user's foot will rest upon the proximal surface of the sole structure.

* * * * *